United States Patent [19]

Shumaker et al.

[11] 4,370,090

[45] Jan. 25, 1983

[54] BOOM LOCK

[75] Inventors: John F. Shumaker, Mt. Pleasant; Herman J. Maurer, Burlington, both of Iowa

[73] Assignee: J. I. Case Company, Racine, Wis.

[21] Appl. No.: 166,060

[22] Filed: Jul. 7, 1980

[51] Int. Cl.[3] ..... E02F 3/32

[52] U.S. Cl. ..... 414/694; 414/685; 414/722; 212/189

[58] Field of Search ..... 414/694, 680, 685, 722, 414/687; 212/189; 280/474; 403/321, 322, 325; 298/38

[56] References Cited

U.S. PATENT DOCUMENTS

| | | | |
|---|---|---|---|
| 3,921,835 | 11/1975 | Baker | 414/694 |
| 4,184,803 | 1/1980 | Housman | 414/694 |
| 4,227,852 | 10/1980 | Schmitz | 414/694 |
| 4,273,502 | 6/1981 | Maurer | 414/694 |
| 4,304,520 | 12/1981 | Schmitz | 414/694 |

*Primary Examiner*—Robert J. Spar
*Assistant Examiner*—Terrance L. Siemens
*Attorney, Agent, or Firm*—Dressler, Goldsmith, Shore, Sutker & Milnamow, Ltd.

[57] ABSTRACT

A lock for holding a boom in a storage position on a boom support is disclosed herein. The lock consists of a first member or vertical pin that is carried by the boom support, a second member or locking ring that is pivoted on the boom about a horizontal axis and that has an opening for receiving the first member, and a deformable biasing element or spring interconnecting the first and second members. The second member is biased to a first position by the spring and engages the vertical pin when the boom is moved to its storage position. When the opening in the locking ring and the vertical pin are axially aligned, the spring returns the second member to the first position latching the first and second members together.

7 Claims, 7 Drawing Figures

BOOM LOCK

DESCRIPTION

TECHNICAL FIELD

The present invention relates generally to earth working implements such as backhoes employing a boom and a boom support upon which the boom is pivoted.

BACKGROUND OF THE INVENTION

In conventional earthworking equipment employing a boom or a boom-like structure, the boom usually must be placed in a special position if the boom is to remain attached to the machine, usually a tractor, when that machine is transported from one work site to another. This position is often referred to as the transport or "transportation position." In such a position the boom is generally brought as close to the center of gravity of the tractor as possible. This is done to improve the stability of the tractor while moving on the open road and to minimize the space occupied by tractor when it is placed in storage. Proper protection of personnel and equipment demands that a positive means be used to hold the boom in the transport position.

In addition, the boom is locked in a near vertical position when it is desired to lift payloads using the earthworking tool attached to the boom. This operation is often referred to as "craning." Locking the boom mechanically when the boom is used like a crane allows the available hydraulic power to be used by the moving components pivoted to the boom.

A representative item of earthworking equipment employing a boom is a backhoe. Backhoes normally consist of a boom that is pivoted on a tractor by a fluid ram and an earthworking tool or bucket assembly that is pivoted on the free end of the boom by a second fluid ram. During transportation or storage, the boom and equipment attached thereto are positioned so as to occupy the least floor space. In addition, this makes movement on public roads more convenient and stable since the center of gravity is shifted closer to the tractor wheels.

A transport position is generally disclosed in Long et al., U.S. Pat. No. 3,376,984. In that patent, the boom is swung to a transport position that is generally vertical and slightly forward of the vertical axis extending through the boom and its support. The boom was held locked in the transport position by the boom fluid ram which had gone "over-center". While that arrangement is acceptable, there are times when it is desirable to positively interlock the boom and its support without relying on the fluid in the boom rams.

One method of positively interlocking the boom and its support without relying on the fluid in the boom rams is disclosed in Shumaker et al., U.S. Pat. No. 3,811,582 and assigned to the assignee of the present invention. Other methods are disclosed in U.S. Pat. Nos. 3,921,835 and 4,184,803. Because of the competitive nature of the industry, manufacturers are constantly striving for improvements which will reduce costs without sacrificing any operational characteristic. A simplified reliable boom lock would be welcomed by the industry.

SUMMARY OF THE INVENTION

According to the present invention, a boom is positively locked to its support in a storage or transport position by using a minimum number of new parts and by incorporating existing components to the greatest possible extent. The locking means, that is utilized to lock the boom on the boom support, automatically moves to the latched position when the boom is moved to the storage or transport position. The locking means is readily released by reversing the sequence of steps which brought the locking means to the latched position.

More specifically, the locking means consists of a first member that is fixed to the boom support and a second member that is carried by the boom and movable relative to the boom. The second member is normally biased to a first position by a deformable biasing means. The two members are located so that the second member engages and slides along the first member as the boom is pivoted to the storage or transport position. The second member has an opening for receiving the first member. The deformable biasing means returns the second member to the first position when the opening in the second member is aligned with the first member thereby latching together the boom and the boom support.

According to one aspect of the invention, the first member that forms part of the locking means is the free end of a pin that is normally utilized in mounting the boom support to the tractor. The pin allows pivotal movement of the boom support about a vertical pivot axis. The second member consists of a ring-like structure that is pivotally supported about a horizontal pivot axis on the boom. The second member is biased by an deformable biasing means or closed helical spring to a first position. The advantage of utilizing a closed helical spring is that it holds the ring in a substantially fixed position during normal manipulation of the boom while allowing a certain amount of stretch when the fluid ram manipulating the dipper stick moves outwardly and away from the boom support. This is especially true in craning operations.

Numerous other advantages and features of the present invention will become readily apparent from the following detailed description of the invention and the embodiment illustrated therein, from the claims and from the accompanying drawings.

DETAILED DESCRIPTION

Figure 1:
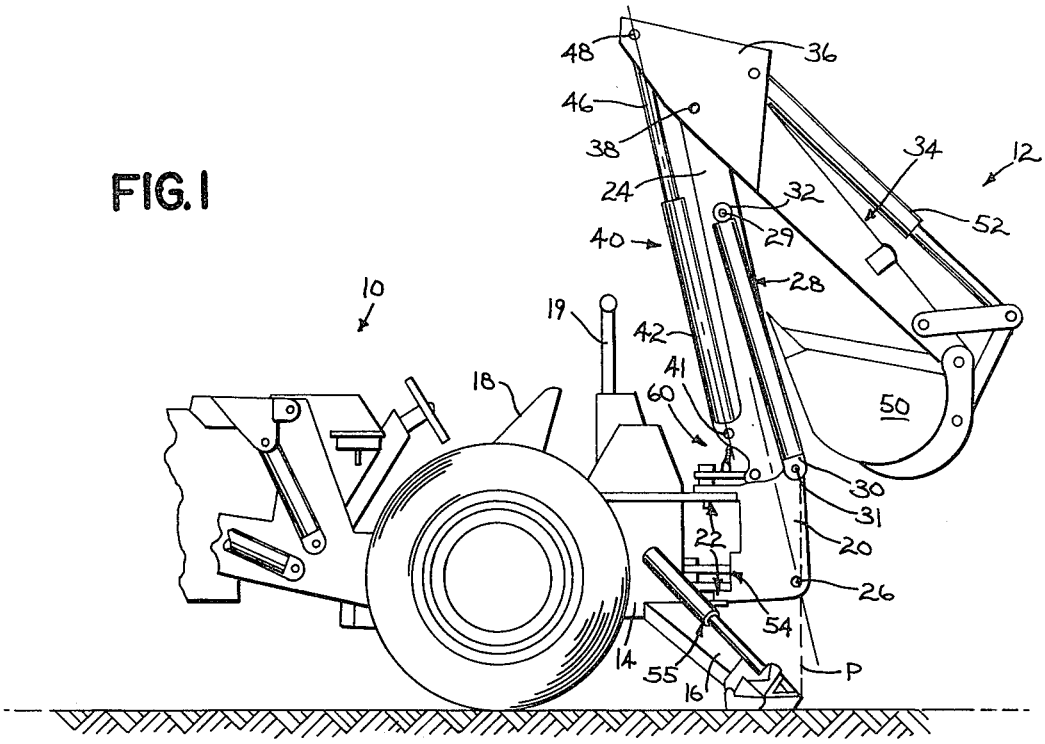
FIG. 1 is a fragmentary, side view of a tractor having an earthworking implement mounted thereon and having the present invention incorporated therein.
Figure 2:
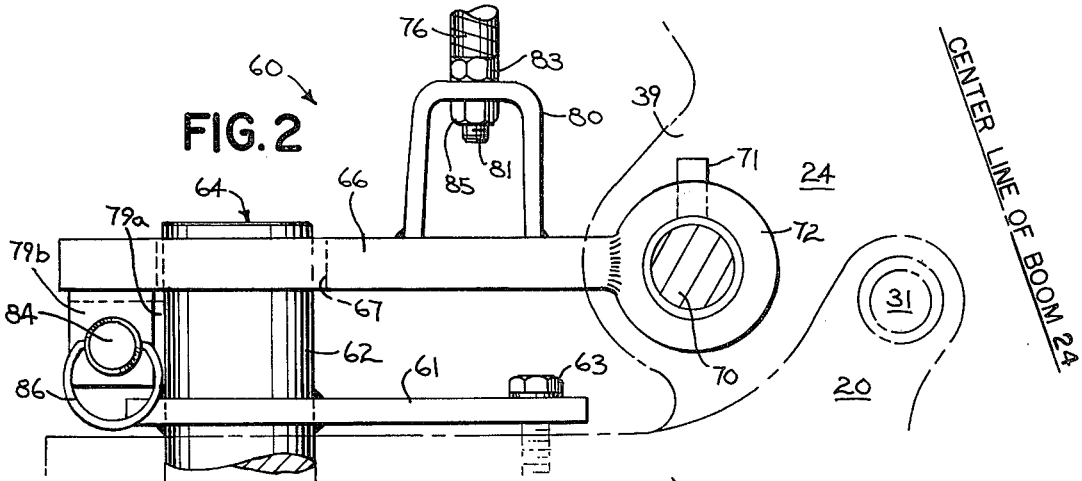
FIG. 2 is an enlarged, fragmentary, elevational view of the locking means illustrated in FIG. 1.

While this invention is susceptible to embodiment in many different forms, there is shown in the drawings and will herein be described in detail one embodiment with the understanding that the present disclosure is to be considered as an exemplification of the principles of the invention and is not intended to limit the invention to the specific embodiment illustrated.

FIG. 1 of the drawing shows a tractor generally designated by reference numeral 10, having an earth-working tool or implement 12 supported thereon. The implement 12 consists of a backhoe which includes a base or frame 14 having outriggers 16 (only one being shown) supported thereon. The frame 14 is attached to the rear end of the tractor 10, adjacent an operator's station 18. The operator's station 18 may be part of the tractor or may be a separate area on the frame 14. Controls 19 are positioned by the operator to manipulate the implement 12.

A swing tower or boom support 20 is pivoted about a vertical axis by a pivoting means 22 defined by two vertical pivot pins, which will be described in more detail later. A boom 24 is supported at its lower end by a horizontal pivot pin 26 on the boom support 20. The boom 24 is pivoted about the horizontal pivot axis defined by the horizontal pivot pin 26 by a pair of boom fluid rams 28 (only one being shown) located on opposite sides of the boom. Each of these fluid rams 28 has its cylinder 30 secured to the boom support 20 by a pin 31 and its piston rod 32 secured to the boom 24 by a pin 29.

A dipper stick assembly 34 is supported on the other end of the boom 24. The dipper stick assembly 34 includes one member 36 pivoted intermediate its ends on the free end of the boom 24 by a horizontal pivot pin 38. Movement of this dipper stick member 36 is controlled by a dipper stick fluid ram 40. The dipper stick fluid ram 40 has its cylinder 42 pivotally supported on the boom 24 adjacent to the boom support 20 by a pin 41. The piston rod 46 of the dipper stick fluid ram 40 is pivoted to one end of the dipper stick assembly 34 by a pin 48. A bucket 50 is provided on the opposite or outer end of dipper stick assembly 34 by a bucket fluid ram 52. Other fluid rams 54, 55 are used to pivot the boom support 20 about the vertical axis defined by pivoting means 22, and to extend and retract the two outriggers 16 (one of which is shown in FIG. 1).

During normal operation of the implement 12, the boom 24 is maintained rearwardly or to the right of a plane P extending vertically through the pivot axis 26 of the boom. The dipper stick assembly 34, bucket 50, and boom 24 are manipulated by using the controls 19 to apply pressurized fluid to opposite ends of the associated fluid rams 40, 52, 28.

As discussed in more detail in the above mentioned patent by Long, when it is desired to move the implement 12 to its overcenter, transport or storage position, the fluid rams 28 positioning the boom 24 are manipulated in such a manner that the boom is moved forwardly to the opposite side of the vertical plane P extending through pivot point 26. The specific manner in which the controls 19 are operated to move the boom 24 to the transport position is explained in more detail in the Long patent which is incorporated herein by reference.

According to the present invention the boom 24 and boom support 20 carry a locking means 60 that automatically latches the boom to the boom support when the boom is moved to the transport or storage position. The locking means 60 consists of two major parts. More specifically, the locking means 60 includes a first member carried by the boom support 20 and a second member carried by the boom 24.

Referring to FIG's. 2 and 3, in one embodiment, the first member is formed by the upper free end 64 of the vertical pivot pin 62 that forms part of the pivoting means 22 defining the vertical pivot axis between the swing tower or boom support 20 and the frame 14. This pin 62 extends upwardly above the frame 14 and boom support 20 and has a free end portion 64. The vertical pivot pin 62 is fixed with respect to the boom support 20 by a plate 61. This plate 61 is joined at one end to the boom support 20 by a mechanical fastener 63 and at its opposite end to the vertical pivot pin 62 by welding or brazing. The vertical pivot pin 62 is rotatably journaled in a bearing (not shown) carried by a portion of the frame 14.

Figure 3:
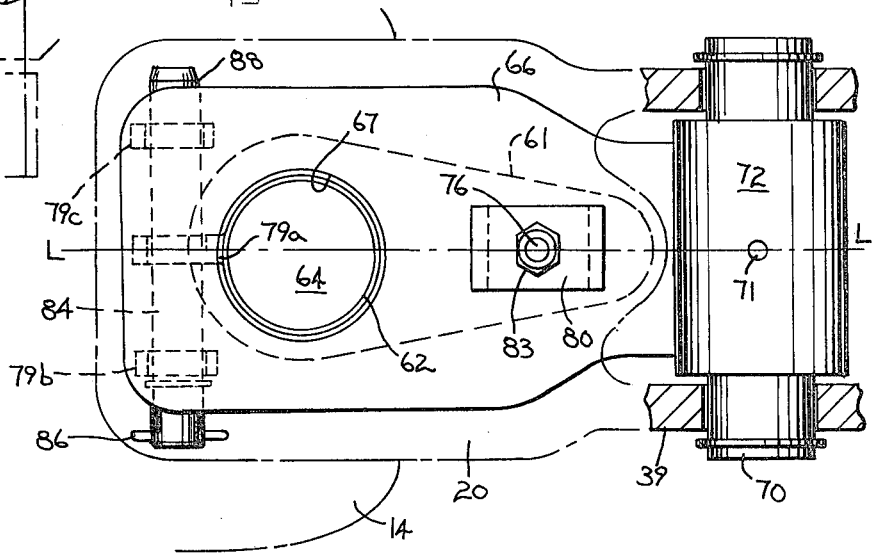
FIG. 3 is an enlarged, fragmentary, plan view of the locking means illustrated in FIG. 2.

The second part of the locking means 60 includes a second member or locking ring 66 (see FIG. 3) that has an opening 67 for receiving the upper free end 64 of the vertical pivot pin 62 or first member. The locking ring 66 is supported for pivotal movement on a pair of ears 39 that form part of the boom 24 by a horizontal pivot pin 70 received through a bushing 72 that is fixedly secured and forms a part of the locking ring 66. As shown in FIG's. 2 and 3, a grease fitting 71 is provided in the bushing to lubricate the interface between the pin 70 and the bushing 72.

The locking ring 66 is normally biased to a first position by a deformable biasing means 76 interposed between the fluid ram 40 operating the dipper stick assembly 34 and the locking ring. The deformable biasing means 76 accommodates movement of the locking ring 66 from the first position in a manner which will be thoroughly explained at a later point in this discussion. Preferably, the deformable biasing means 76 is in the form of a long, closed helical spring (i.e. a coil spring having each successive wire wrap layed one atop the other in such a manner that the interior is hidden from view and having a length substantially greater than its diameter). However, other springs may be used (e.g. open coil springs). The particular spring selected will have a force constant such that it is relatively self supporting without overly resisting compression or distortion. Other devices having similar physical properties may be used. One end of the deformable biasing means 76 is connected to a lower bracket 80 carried by the locking ring 66. The opposite end of the deformable biasing means 76 (see FIG's. 4, 5, 6 and 7) is connected to an upper bracket 82 carried by the cylinder portion 42 of the fluid ram 40 used to manipulate the dipper stick assembly 34. As shown in the figures, the two ends of the spring 76 are joined to the brackets 80, 82 by ordinary threaded fasteners. A stud 81 may be easily threaded into one end of a helical spring; one nut 83 holds the stud 81 and the spring 76 together while a second nut 85 holds the stud on the bracket 80. The upper end of the spring 76 is similarly joined to the upper bracket 82.

Figure 4:
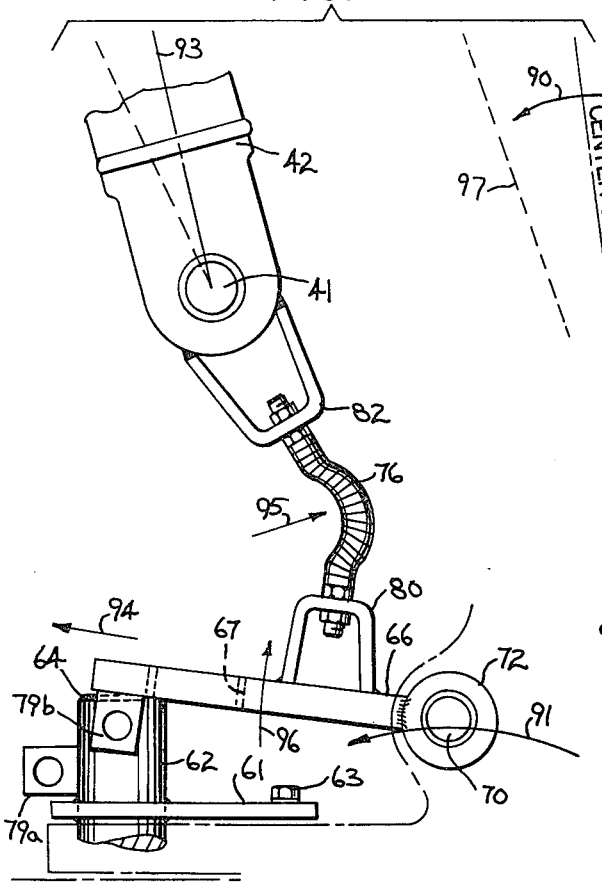
FIG. 4 is an enlarged partial, elevational view of the locking means shown in FIG. 2 just prior to tripping towards the "latched position"

The operation of locking means 60 will now be described with reference to FIG's. 4, 5, 6 and 7. As was indicated above, the boom 24 moves forwardly (arrow 90) across the vertical plane P extending through the pivot axis 26 in moving to an over-center, transport or storage position (dotted line 97). When the pin 70, defining the pivot axis for the second member or locking ring 66 is forward of the vertical plane P, the locking ring is in a position represented in FIG. 4. Here the dipper stick ram cylinder 42 is shown in the transport position (center line 93). In this position the lower surface of the locking ring 66 is just slightly above the top of the free end portion 64 of the first member or the vertical pivot pin 62. Continued pivotal movement (arrow 90) of the boom 24 about the pin 26 defining its horizontal pivot axis (see FIG. 1) will cause the locking ring 66 to move along an arc (arrow 91) about the pivot axis of the boom. During this movement, engagement is created between the lower surface of the locking ring 66 and the free end portion 64 of the vertical pivot pin 62. Engagement of these two members slides (arrow 94) the locking ring 66 atop the vertical pivot pin 62 and applies an upwardly directed force to the spring 76 which buckles or deforms the spring (arrow 95) without inhibiting the rotation of the boom 40.

Figure 5:
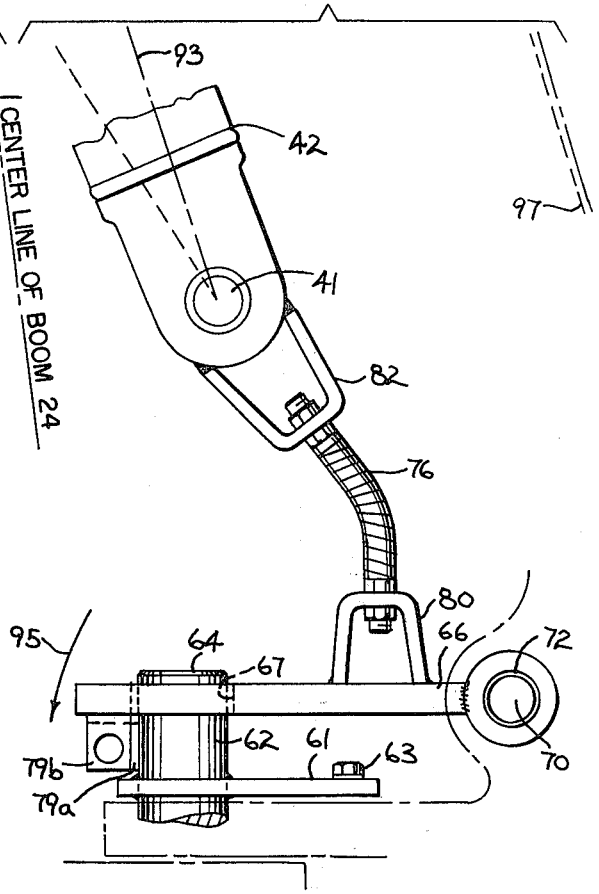
FIG. 5 is an enlarged, partial, elevational view of the locking means shown in FIG. 2 in the "latched position;"

Since the spring 76 is free to deform, or compress, the locking ring 66 pivots upwardly (arrow 96) during its engagement with the upper end 64 of the vertical pivot pin 62. As the opening 67 in the locking ring 66 comes in general vertical alignment with the vertical pivot pin 62, the spring 76 reacts (arrow 95) to move the locking ring 66 to the engaged position or latched position (see FIG. 5). In this position the opening 67 in the locking ring 66 surrounds the vertical pivot point 62 to provide a lock or latch between the boom 24 and the boom support 20. This will hold the boom 24 in a transport or storage position (dotted line 97) with respect to the boom support or swing tower 20 until such time as the second member or the locking ring 66 is released from the first member or the vertical pivot pin 62.

At this point it is appropriate to mention another feature of the present invention. In order to provide a positive lock or latch (i.e. one not relying on hydraulic pressure alone or one which cannot easily become unlatched through vibration or by the loss of hydraulic fluid, etc.) between the boom 24 and boom support 20 when the boom is in the transport position, the locking means 60 includes a manually applied pin lock. Referring to FIG's 2 and 3, the forward end of the vertical pivot pin 62 is provided with a radially aligned tang or lug 79*a*. This lug 79*a* is joined to the pin 62 by a process such as welding or brazing. The lug 79*a* can also be formed directly in the process of forging the pin 62. In any case, two complementary lugs 79*b*, 79*c* are provided on the lower surface of the locking ring 66. All three lugs 79*a*, 79*b*, 79*c* are provided with an opening to receive a removable pin 84 called a "craning pin." Inserting the craning pin 84 through the openings in the two lugs 79*b*, 79*c* in the locking ring 66 and the lug 79*a* joined to the vertical pivot pin 62, positively locks the locking ring 66 to the vertical pivot pin 62 and the boom 24 to the boom support 20. A ball detent or snap connection 88 at the one end of the craning pin 84 insures that the pin remains in place when the tractor 10 is transported. A pull ring 86 at the head of the craning pin 84 may be used to facilitate removal of the pin.

Figure 6:
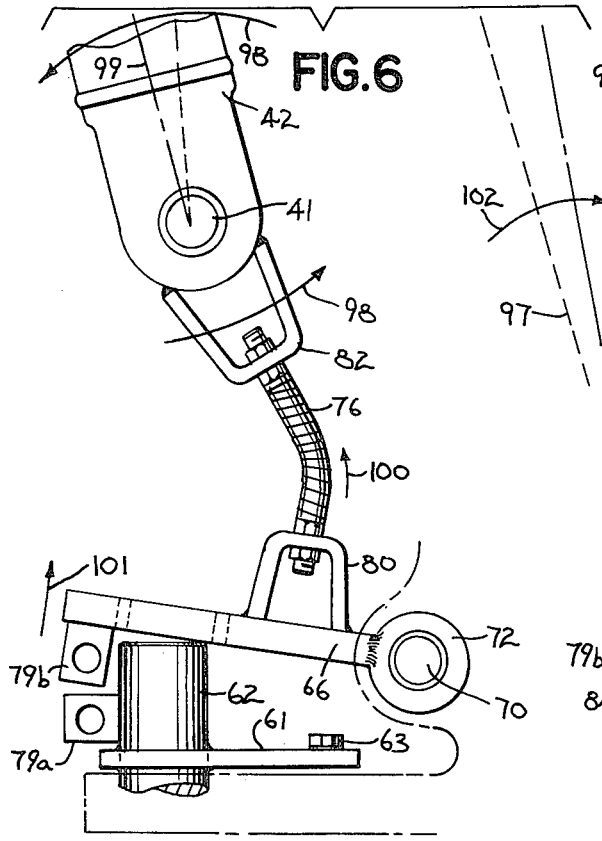
FIG. 6 is an enlarged, partial, elevational view of the locking means shown in FIG. 2 in the "unlatched position"

To release the boom 24 from the boom support 20, it is only necessary for the operator to manipulate the controls 19 for actuating the fluid rams 40, 28 used to position the dipper stick assembly 34 and boom. Specifically, and referring to FIG. 6, the dipper stick fluid ram 40 is actuated to drive its piston rod 46 inwardly to extend the dipper stick assembly 34 relative to the boom 24. This in turn will cause the cylinder 42 to rotate in a counterclockwise direction (arrows 98). The counterclockwise rotation of the cylinder 42 rotates the bracket 82 counterclockwise (arrows 98) about the associated pivot pin 41. This in turn draws the spring 76 upwardly (arrow 100) and rotates the locking ring 66 about its pivot pin 70 which in turn lifts (arrow 101) the locking ring free of the upper end 64 of the vertical pivot pin 62. The dipper stick cylinder 42 will rotate to a position (center line 99) where the maximum moment arm is formed to rotate the dipper stick assembly 34 before rotating clockwise. Once the second member or locking ring 66 has been freed or lifted clear (arrow 101) of the first member of the vertical pivot pin 62, the boom 24 may be rotated (arrow 102) free from the transportation position (center line 97).

Figure 7:
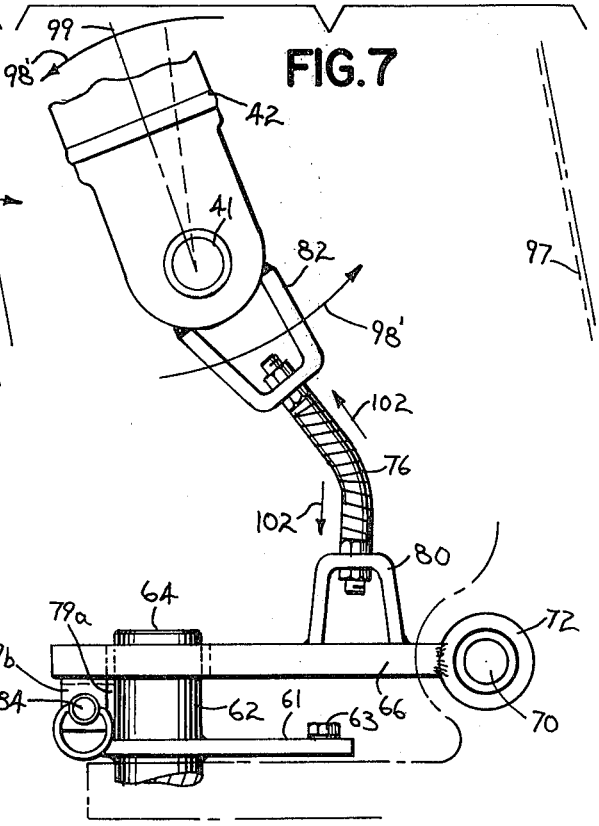
FIG. 7 is an enlarged, partial elevational view of the locking means shown in FIG. 2 in the latched position with the craning pin installed.

FIG. 7 illustrates the relative movement of the components forming the locking means 60 when the craning pin 84 has been installed. As previously mentioned, there are certain times during the operation of a backhoe when it is convenient to use the dipper stick assembly 34 as a crane (e.g. laying sewer pipe in a trench). In these situations it is desirable that the boom 24 remain fixed in place relative to the boom support 20 while the dipper stick assembly 34 is rotated relative to the boom. The manner in which the locking ring 66 is lifted free from the pivot pin 62 was just described. Essentially, the locking ring 66 was freed from the vertical pivot pin or first member 62 by the pivotal rotation of the dipper stick ram 40 relative to the boom 24. By inserting the craning pin 84 into the three coaxially aligned lugs 79*a*, 79*b* and 79*c* the boom 24 will remain latched to the boom support 20 regardless of the rotation (arrows 98') of the dipper stick ram 42. However, with the locking ring 66 latched to the vertical pivot pin 62 by the craning pin 84, the spring 76 must of necessity expand or "stretch" to take up the force of the rotation of the dipper stick cylinder 42 relative to the locked boom 24 and boom support 20. As illustrated in FIG. 7 with the craning pin 84 installed, the spring 76 extends in length (arrows 102) relative to the position it would have maintained had the craning pin 76 not been installed (see FIG. 6) while the dipper stick ram 40 was rotated through the overcenter position.

As can be appreciated from the foregoing description, the locking means 60 which latches together the boom 24 and boom support 20 can be incorporated into an existing machine with a minimum amount of modification and by using inexpensive and readily available parts. While the locking means 60 and its operation has been shown and described in connection with overcenter-type boom, the same unique arrangement can readily be incorporated into a boom structure wherein the boom never travels across vertical plane P. In such an arrangement, it may be necessary to produce an inclined camming surface on the rear end of the first member or the vertical pivot pin 62 so that the second member or locking ring 66 will be pivoted from the first position (FIG. 5) to the second position (FIG. 6) while the boom 24 is moving along a path where the pivot pin 70 is continually moved upwardly. The unique operational characteristics of the deformable biasing means or spring 76 provide the required spacial relationship between the two rigid components 62, 66 of the locking means 60.

It should be evident that many alternatives, modifications and variations will be apparent to those skilled in the art in light of the foregoing detailed description. Accordingly, it is intended to cover all such alternatives, modifications, and variations as set forth within the spirit and broad scope of the appended claims.

What is claimed is:

1. In an earthworking machine having a boom pivoted on a frame about a horizontal pivot axis between raised and lowered positions by a first fluid ram joining said frame and said boom; a material handling implement pivoted intermediate its ends on the other free end of said boom about a horizontal pivot axis between folded and extended positions by a second fluid ram having one of its piston rod and cylinder elements pivotally connected to said material handling implement adjacent one free end thereof and the other of its piston rod and cylinder elements pivoted on said boom adjacent said frame; and releasable lock means for locking said boom relative to said frame to prevent pivotal movement of the boom about its horizontal pivot axis, said releasable lock means comprising: a first member secured to said frame; a second member pivotally mounted relative to said boom and disposed adjacent said first member; and biasing means extending directly between and rigidly affixed to said second member and said other piston rod and cylinder elements of said second fluid ram for urging said second member to pivot away from said first member when said second fluid ram is actuated to unfold said material handling implement relative to said boom and for urging said second member to engage said first member when said implement is folded relative to said boom and said boom is pivoted to the raised position whereby said second member engages said first member to lock said boom relative to said frame.

2. In an earthworking machine having a boom pivoted about a horizontal pivot axis on a support with an earthworking implement pivoted intermediate its ends on the free end of said boom through a fluid ram having one end pivotally connected to said boom and an opposite end pivotally connected to a free end of said earthworking implement, said support being pivoted about a vertical pivot axis on a base with said vertical pivot axis being defined by at least one pin that is fixed to one of said base and support and that is rotatable on the other of said base and support, apparatus for locking together said boom and said support, comprising: a first member carried by said support; a second member carried by said boom and disposed adjacent said first member, said second member including a ring structure pivoted about a horizontal pivot axis on said boom and having an opening within its confines for receiving said first member, said first member being the upper free end portion of said one pin; and biasing means, extending directly between and rigidly affixed to said second member and said one end of said fluid ram, for biasing said second member in a first position and for accommodating movement from said first position, said first and second members being positioned relative to one another so that pivotal movement of said boom and said earthworking implement to a storage position, where said implement is folded relative to said boom and said boom is folded relative to said support, produces engagement between said first and second members and drives said second member from said first position, said biasing means urging said second member to return to said first position when said first member is aligned with the opening in said second member whereby said boom and said support are latched together, subsequent extension of said earthworking implement relative to said boom displaces that end of said biasing means joined to said one end of said fluid ram whereby said second member is lifted free from said first member and said boom is freed from said support.

3. An earthworking machine as specified in claim 1 or 2, further including second means, coupling said first member and said second member, for locking said boom relative to said frame while still permitting said boom to pivot about a vertical axis.

4. The earthworking machine as specified in claim 1, wherein said first member is a pin-like protrusion extending upwardly from said frame and disposed towards the upper end of said boom when said boom is in the raised position.

5. The earthworking machine as specified in claim 1 or 2, wherein said biasing means is a closed helical spring.

6. The earthworking machine as specified in claim 1 or 5, wherein the longitudinal axis through said biasing means defines a curved line segment when said second member is in said position latched to said first member.

7. The earthworking machine as specified in claim 1 or 2, wherein the neutral axis of said biasing means defines a curved line segment when said second member is in its position free from said second member.

* * * * *